United States Patent [19]

Hurst

[11] Patent Number: 4,846,455

[45] Date of Patent: Jul. 11, 1989

[54] HIGH SPEED ENVELOPE FEEDING APPARATUS

[76] Inventor: Richard F. Hurst, 126 Steeplechase Rd., Devon, Pa. 19333

[21] Appl. No.: 179,585

[22] Filed: Apr. 8, 1988

[51] Int. Cl.[4] ..... B65H 5/00

[52] U.S. Cl. ..... 271/2; 271/4; 271/10; 271/129; 271/184; 271/225

[58] Field of Search ..... 271/2, 3, 3.1, 4, 6–7, 271/9–10, 31.1, 129, 139, 140, 149, 150, 184, 185, 12, 18.1, 119, 141, 142, 306, 112, 225, 298; 53/381 R, 266 A

[56] References Cited

U.S. PATENT DOCUMENTS

| | | | |
|---|---|---|---|
| 2,038,645 | 4/1936 | Cherry et al. | 271/2 |
| 2,554,577 | 5/1951 | Lauffer | 271/2 |
| 2,572,509 | 10/1951 | Norick | 271/150 |
| 3,962,848 | 6/1976 | Hankins | 271/112 X |
| 4,227,687 | 10/1980 | Schoonmade | 271/139 |
| 4,690,392 | 9/1987 | Coons, Jr. | 271/2 |
| 4,756,521 | 7/1988 | Martin | 271/225 |

*Primary Examiner*—Douglas C. Butler
*Attorney, Agent, or Firm*—John B. Sowell

[57] ABSTRACT

A high speed envelope feeder is provided with a pair of pinch rolls for extracting an envelope from a stack of closed envelopes in a magazine. The flap of a closed envelope is opened by raising a cam surface under the flap to position the flap between a fixed pinch roll and a movable pinch roll. The movable pinch roll is articulated to grasp the flap between the pinch rolls. The flap is pulled to extract the envelope from the magazine and is subsequently pushed by the pinch rolls into the transport device.

19 Claims, 2 Drawing Sheets

HIGH SPEED ENVELOPE FEEDING APPARATUS

BACKGROUND OF THE INVENTION

1. Related Applications

The present invention is an improvement of my co-pending application Ser. No. 65,292 filed June 22, 1987 and entitled "A Picker-Stripper-Feeder For Envelope Feeding Apparatus."

2. Field of the Invention

The present invention is related to continuous envelope feeders of the type adapted to be used in conjunction with printers or labelers which place information on the envelope. More particularly, the present invention relates to a novel selection and feed apparatus for high speed extraction of a single envelope from a magazine or stack of envelopes without jamming or double feeding two envelopes.

3. Description of the Prior Art

U.S. Class 271, Subclass 2 contains sheet feeding or delivering apparatus for delivering envelopes and contains patents dating before 1900 which teach envelope feeders. Prior art envelope feeders including my aforementioned application Ser. No. 65,292 have recognized that it is virtually impossible to stack envelopes horizontally, vertically or otherwise in a magazine and to be assured that a single envelope will be removed by prior art envelope feeders. This problem becomes more acute when the speed of the envelope feeder is increased. My co-pending U.S. application Ser. No. 65,292 teaches a structure which picks, then strips and subsequently feeds a closed flap envelope into means for transferring the envelope to a utilization device. It has been found that two or all of the operations of picking, stripping and feeding can be combined into one continuous step cooperating with the transfer means so as to provide a simpler and faster envelope feeding apparatus as will be described in detail hereinafter.

It would be extremely desirable to provide an economical and predictably repeatable envelope feeder which is very small in size, has fewer parts, is cheaper to manufacture and service and is faster than envelope feeders known in the prior art in the same price range.

SUMMARY OF THE INVENTION

It is a principal object of the present invention to provide a simple and economical apparatus for removing a single envelope from a stack of envelopes and for successively feeding the individual stripped envelope to a transport means which innerconnects with a utilization device.

It is another principal object of the present invention to provide apparatus for extracting a single envelope from a stack of envelopes that embodies only two major components or structural items which perform the extraction of the envelope.

It is another principal object of the present invention to provide a novel envelope extraction apparatus which is capable of extracting different size envelopes and feeding them into a transport device.

It is another principal object of the present invention to provide an envelope extraction apparatus which pulls an envelope from a stack of envelopes by the open flap of the envelope and is capable of supplying either the open or a closed envelope to the envelope transport means.

It is another general object of the present invention to provide a simple and reliable sheet feeder which may be attached to the envelope extraction apparatus for selectively feeding single or plural envelopes and sheets in a predetermined sequence.

It is another general object of the present invention to provide an envelope extraction apparatus which can supply an envelope to a utilization device straight through the transport means or at a 90° orientation to the direction of feed of the transport means.

It is a general object of the present invention to provide the present envelope feeder with sensing means and controls similar to those set forth in my co-pending application Ser. No. 65,292 in addition to providing novel selectable processor control means for selecting envelopes and sheets intermittently.

According to these and other objects of the present invention there is provided apparatus for extracting an envelope from a stack of closed envelopes in a magazine of a plurality of envelopes by lifting the flap of the envelope to be extracted so that it is positioned between a fixed pinch roll and a movable pinch roll and then articulating the movable pinch roll so that the exposed open flap is grasped between the pinch rolls and the flap is pulled to extract the envelope from the magazine and the envelope is subsequently pushed by the pinch rolls into the transport means.

DESCRIPTION OF THE PREFERRED EMBODIMENT

Figure 1:
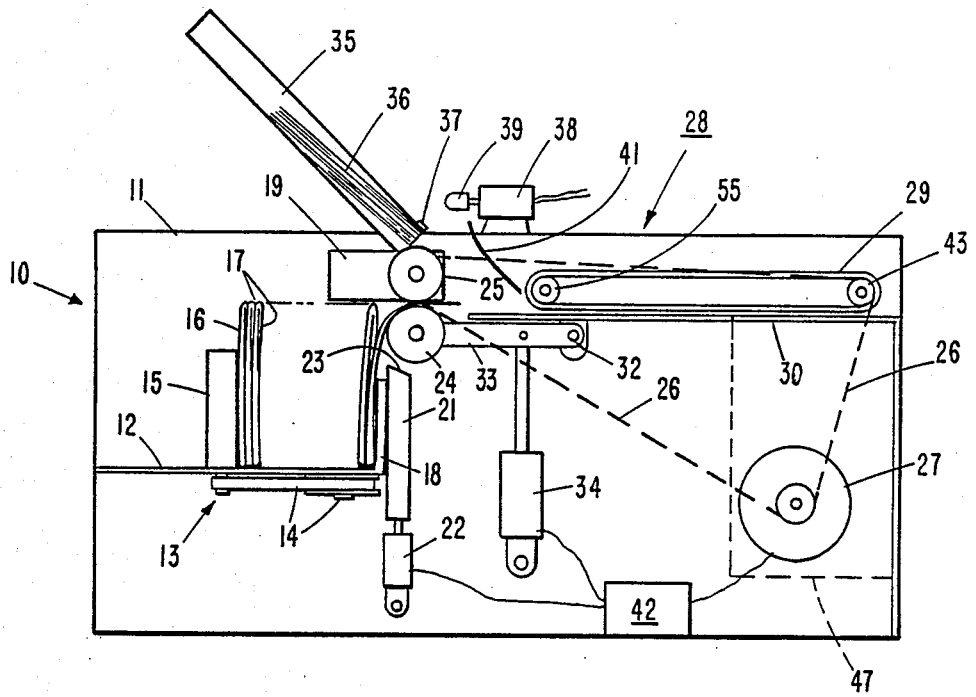
FIG. 1 is a side view and partial section of a simplified diagrammatic envelope extraction apparatus shown preparing to extract the open flap of an envelope from a stack of envelopes in a magazine.

Refer now to FIG. 1 showing a side view in partial section of the preferred embodiment envelope extraction apparatus 10 which comprises a pair of side frames 11 that support a magazine tray generally shown at 12. The magazine tray 12 is provided with a constant tension feed assembly 13 comprising a coil spring 14 and an stanchion 15 which rides in a slot in magazine tray 12. The envelopes 16 are provided with closed flaps 17 which face the open end of the tray 12 that is provided with restraining means 18 which engage the envelopes below the flap 17. Vertical motion restraining means 19 are shown extended over the lead envelope and a plurality of adjacent envelopes in the magazine tray. Flap opening means 21 is shown vertically and slidably mounted at the side frames 11 or the restraining means 18 at the end of the envelope tray by slide guides or other well known means not shown. The movement of flap opening means 21 is shown provided by an electromagnetic device or solenoid 22 which moves the cam 23 on top of the opening means 21 upward under the flap of an envelope 16 so as to cause the flap 17 to open and position itself above the movable pinch roll 24. Movable pinch roll 24 is shown in its closed or pinching position grasping the envelope flap 17 between movable pinch roll 24 and fixed pinch roll 25 which is driven by a common belt 26 and motor 27. The envelope 16, with its flap 17 shown grasped between the pinch rolls 24 and 25, is initially pulled from the stack of envelopes in the magazine 12 and then pushed into the transport means 28 which comprises belt drive means 29 and a tray or platform 31 which is preferably adjustable so that the edges or side guides are positionable to accept envelopes of different widths from magazine 12 in transport means 28.

Movable pinch roller 24 is shown pivotally mounted at pivot 32 which is attached to the side frames 11 or the tray 31. Pivot lever 33 pivots at pivot 32 and supports rotatable and movable pinch roller 24 which is positioned by electro-magnetic means 34. Pivot lever 33 may be positioned by other drive means such as a cam (not shown) driven by motor 27 or its own cyclical drive motor.

A sheet feed tray 35 is shown positioned opposite the input or inlet to the transport means 28. Sheet feed tray 35 is preferably a commercially available sheet feed tray of the type used with xerography machines. Tray 35 is mounted in a slide or recess so as to present a plurality of sheets of paper 36 at the top surface of the tray under sheet restraining means 37 which holds the front of the top sheet at its edges at a position ready to be fed into the transport means 28. Sheet removal means 38 are preferably mounted on the frame 11 or a cross member thereon and is provided with a resilient probe 39 which engages the top sheet and moves it from underneath the edges of the sheet restraint means 37 and then retracts to feed assist the top sheet in sheet feed tray 35 which is then gravity fed between the belt drive means 29 and the tray 31 of transport means 28. Sheet deflector guide 41 is provided to ensure that sheets leaving feed means 35 are properly positioned into the input of the transport means 28.

As will be explained in greater detail hereinafter the programmable control means 42 preferably includes a microprocessor chip which is programmed to sequentially and selectively operate the solenoids or electromagnetic devices 22, 34 and 38 as well as motor 27 and other sensors and motors of the type embodies in my co-pending application.

Figure 2:
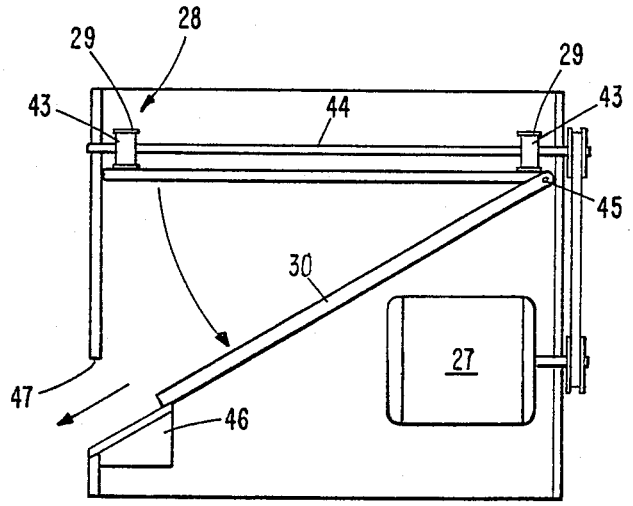
FIG. 2 is an end view of the apparatus shown in FIG. 1 further showing a simplified feed direction chute.

Refer now to FIG. 2 which is an end view of the apparatus shown in FIG. 1. FIG. 2 shows that the transport means 28 further comprises a pair of belts 29 which are mounted on pulleys 43. The pulleys 43 are slidably mounted on drive shaft 44 to permit parallel adjustment and adaptation to different widths of envelopes 16. Pulleys 43 are preferably provided with lock screws not shown for fixing the pulleys 43 to the shaft 44. The lower tray or platform 31 is provided with a end portion 30 which is pivotally mounted at pivot 45 to permit positioning the end portion 30 at an angle to provide a chute which will issue or discharge the envelope from the transport means 28 at an angle orthogonal to the direction of drive of the transport means. A lower stop 46 and a similar upper stop (not shown) permits positioning of the chute 30 at the up or down position as shown. In the down position the envelope exits through side opening or aperture 47.

Figure 3:
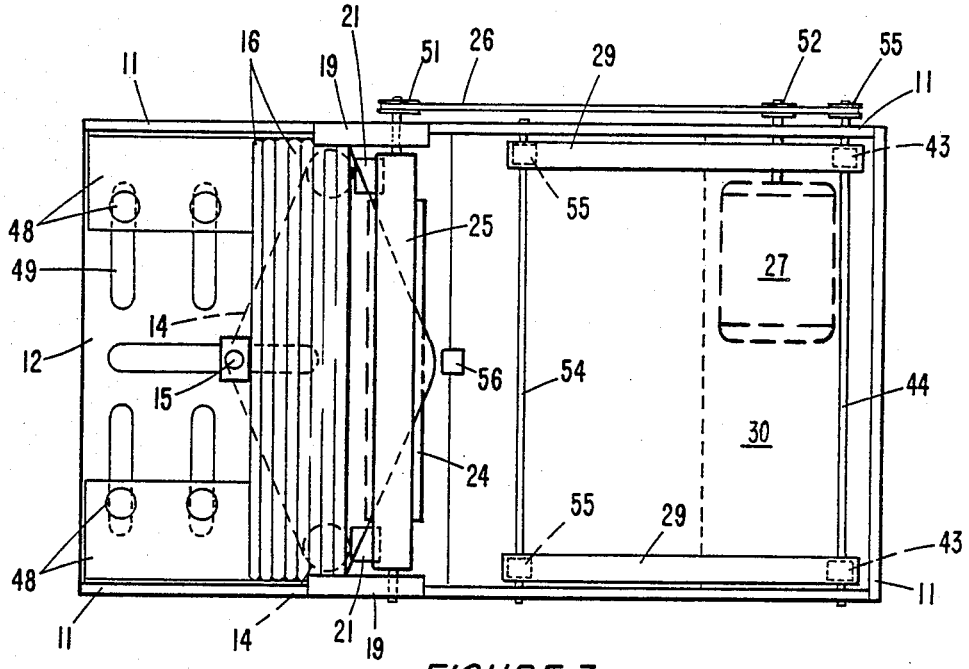
FIG. 3 is a top view in partial section of the apparatus shown in FIG. 1 with the sheet feeder removed.

Refer now to FIG. 3 showing a top view in partial section of the apparatus of FIG. 1 having the sheet feeder removed. Magazine or tray 12 is shown provided with L shaped side guides 48 which are movable in slots 49 to provide parallel adjustment for different sizes of envelopes. Flap opening means 21 are shown as a pair of vertically slidable post having inclined cam top surfaces 23 engaged under the edge portion of the flap 17 of the envelope 16 which is being extracted from the magazine 12. The movable pinch roll 24 is shown under the flap 17 and under the fixed pinch roll 25. Pinch roll 25 is mounted on a through shaft on side frames 11 and rotated by a pulley 51 which is driven by belt 26 and motor 27. The belt 26 also drives transport means pulley 53 which is connected to transport means pulley shaft 54 having movable crown pulleys 55 mounted thereon. It will be understood that the pulleys 43 and 55 are movable on their respective shafts 54 and 44 so as to position the belts 29 in parallel alignment with the side frames 11 to engage envelopes of different sizes. In a similar manner, flap opening means could be made adjustable and driven by a single electro-magnetic device 22.

An envelope flap deflector 56 is provided on the front edge of tray or platform 31 to close the open flap of an envelope if so desired. It will be understood that envelope flap deflector 56 is removable from the tray 31 when it is desired that the envelope remain open through the transport means 28.

Figure 4:
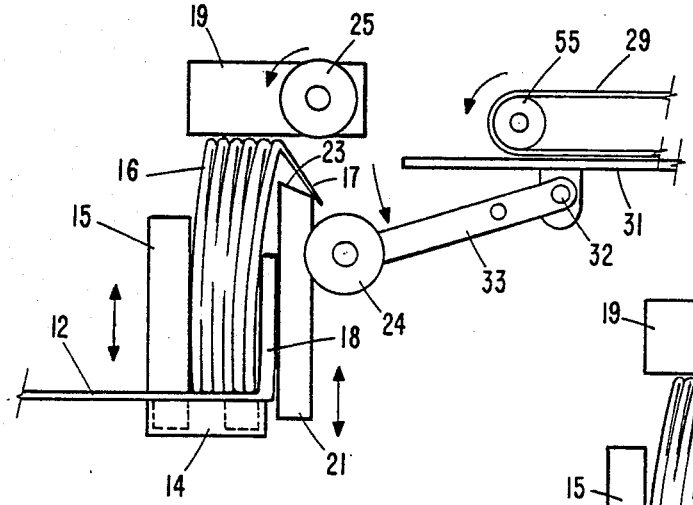
FIGS. 4 and 5 are enlarged side views of the pinch rolls and the flap opening apparatus at different operation positions illustrating the model mode of operation of the present invention.
Figure 5:
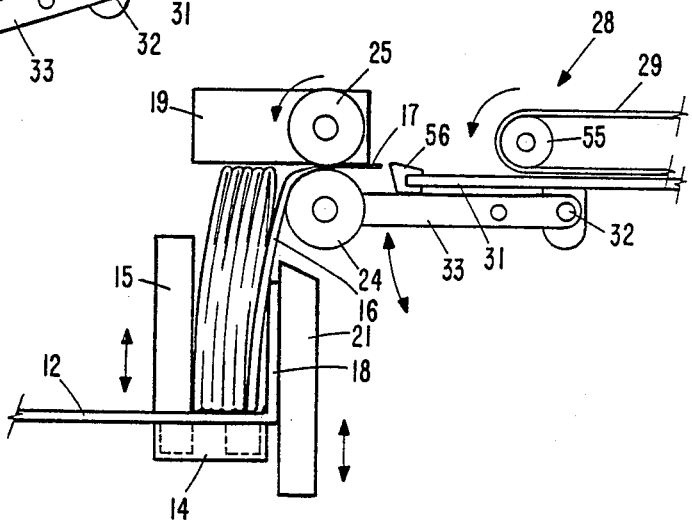

Refer now to FIGS. 4 and 5 which are enlarged side views of the pinch rolls 24 and 25 and the flap opening apparatus 21 shown at different operational positions. Magazine tray 12 is shown supporting a plurality of envelopes 16 having their flaps closed and being urged into engagement with magazine tray restraining means 18 by stanchion 15 and coil spring means 14. Vertical motion restraint or restraining means 19 preferably engages the tops of the envelopes 16 by adjusting the bottom of tray 12 either upward or downward for different heights of envelopes. The restraining means 18 engages the bottom of the envelope 16 below the flap 17 which permits the flap opening means 21 to move upward vertically and engage its inclined cam surface 23 under the flap of the envelope 16 preferably at the edges as was shown in FIG. 3. This leaves the center section of the flap where the longest portion of the flap 17 occurs opposite the movable pinch roll 24. In the preferred mode of operation the cam surface 23 is capable of lifting and bending the flap 17 so that it is positioned on top of the movable pinch roll 24 as shown in FIG. 4. Since the movable pinch roll 24 is preferably independently movable of the flap opening means 21, the movable pinch roll 24 can start its upward pivotal movement from the position shown in FIG. 4 and trap or engage the flap 17 between pinch rolls 24 and 25 as shown in FIG. 5. As will be explained hereinafter, flap opening means could be articulated by the same drive employed to drive movable pinch roll 24.

In the preferred mode of operation the fixed pinch roll 25 continuously moves whether or not an envelope or a sheet is being fed. Thus, when the pinch roll 24 engages the flap 17 of envelope 16 between the pinch rolls, the envelope 16 is pulled vertically from the tray 12 and bent and wrapped around a sector of the movable pinch roll 24 while projecting the flap 17 below the horizontal plane toward the transport means 28. Continued movement of the drive pinch roll 25 pushes the envelope flap 17 over the top ledge of tray or platform 31 and into the transport means between the moving belt 29 and support tray 31. The envelope flap deflector 56 previously shown in FIG. 3 is shown in phantom lines in FIG. 5 in the path of the flap 17 being ejected substantially horizontally from between the pinch rolls 24 and 25. It will be understood that the envelope flap deflector 56 is preferably a manually removable finger or guide which serves to divert or tuck the flap 17 downward so that an open envelope normally being fed into the transport means 28 is closed before entering the transport means 28. The envelope flap 17 is directed below the horizontal plane while the body of envelope 16 is pushed horizontally above deflector 56.

Having explained the preferred operation of the pinch rolls and flap opening apparatus it will be understood that the pinch roll 24 can be positioned so that the flap being opened by the flap opening means 21 engages or rubs against the pinch roll 24 before being positioned above the pinch roll 24. It is also possible to position the pinch roll 24 in a lower position so that the flap opening means 21 opens the flap without engaging the movable pinch roll 24. This permits flexibility of operation when handling envelopes of different rigidity and weight. In the preferred mode of operation when the envelope extraction apparatus is completely synchronized by the microprocessor control 42 there is no need or requirement that the flap 17 of the envelope engage the movable pinch roll 24. In the prototype apparatus, it was observed that speeds in of 100 envelopes per minute are easily obtained without having to position the movable pinch roll 24 in a higher position where the flap 17 would engage the pinch roll 24 before being positioned over the pinch roll 24.

As mentioned hereinbefore, the flap opening means 21 is preferably guided in slides to provide vertical movement and that electromechanical means 22 moves means 21 under control of control means 42. Having explained the preferred sequential operation of means 22 and 34, it will now be understood that means 21 can be moved by means 34 which moves movable pinch roll 24. This is especially true when a cyclical motor with a pair of drive cams are substituted for means 22 and 34 because the preferred sequential operation of means 21 and 24 is preserved. When means 21 is moved by means mounted on pinch roll 24's support means, it is more difficult to preserve this sequential mode of operation and the limits of travel of cam 23 should be curtailed after it raises the flap 17. This effectively preserves the preferred mode of operation.

Having explained the and preferred mode of operation of the present on apparatus it will be understood that the in this application are exaggerated and diagrammatic informed to more clearly illustrate the principles and mode of operation of the novel structure.

What is claimed is:

1. Apparatus for extracting a single envelope from a stack of closed envelopes and for feeding the extracted envelope into a transport device comprising:

magazine means for supporting a stack of envelopes having the closed flap exposed in the feed position at an open end of the magazine means, first restraining means fixed to said open end of said magazine for restraining the lower portion of said envelope below said exposed flap, second restraining means fixed relative to said magazine means for restraining said envelopes in said magazine from vertical upward movement, movable pinch roll means positioned opposite said exposed flap in a normal open position, flap opening means engagable under said closed flap of an envelope for pivoting said closed flap to an open position above said movable pinch roll means in said normal position, fixed pinch roll means positioned above said open envelope flap and opposite said movable pinch roll means when moved to close position to pinch said flap of said envelope between said pinch rolls, means for moving said movable pinch roll into engagement with said fixed pinch roll and for pinching said open envelope flap, and drive means for driving said fixed pinch roll and for extracting said envelope from said stack of envelopes and for feeding said envelope into said transport means.

2. Apparatus for extracting an envelope as set forth in claim 1 wherein said flap opening means comprises an inclined cam surface.

3. Apparatus for extracting an envelope as set forth in claim 1 wherein said flap opening means comprises a pair of vertically movable cams on top of movable slides adapted to engage the outer edge of said envelope flap.

4. Apparatus for extracting an envelope as set forth in claim 2 wherein said flap opening means is adapted to bend said flap over a portion of said movable pinch roll.

5. Apparatus for extracting an envelope as set forth in claim 4 wherein said movable pinch roll is adapted to lift said flap to a horizontal position.

6. Apparatus for extracting an envelope as set forth in claim 5 wherein said movable pinch roll is adapted to engage said flap against said fixed pinch roll and to pull said envelope from said stack by bending said envelope over said movable pinch roll.

7. Apparatus for extracting an envelope as set forth in claim 6 wherein said envelope is collapsed over a sector portion of said movable pinch roll and pushed into said transport means.

8. Apparatus for extracting an envelope as set forth in claim 1 which further includes pivot support means for supporting and moving said movable pinch roll and said flap opening means.

9. Apparatus for extracting an envelope as set forth in claim 8 wherein said pivot support means comprises solenoid means for pivoting said movable pinch roll.

10. Apparatus for extracting an envelope as set forth in claim 8 wherein said pivot support means comprises a rotatable cam.

11. Apparatus for extracting an envelope as set forth in claim 2 which further includes solenoid means for moving said inclined cam into engagement with said envelope flap.

12. Apparatus for extracting an envelope as set forth in claim 1 wherein said transport means comprises a transport platform and a movable driven belt adapted to feed an envelope through said transport means.

13. Apparatus for extracting an envelope as set forth in claim 12 which further includes flap closing means mounted on said transport means.

14. Apparatus for extracting an envelope as set forth in claim 13 wherein said flap closing means comprises a flap diverter mounted on said transport platform.

15. Apparatus for extracting an envelope as set forth in claim 12 wherein said transport means comprises an inclined side chute for feeding a utilization device at ninety degrees to the direction of said movable belt of said transport means.

16. Apparatus for extracting an envelope as set forth in claim 12 wherein said drive means comprises a motor and belt means for driving said fixed pinch roll means and said transport means.

17. Apparatus for extracting an envelope as set forth in claim 1 which further includes a sheet feeder adapted and sheet release means for selectively feeding a sheet of paper into said transport means.

18. Apparatus for extracting an envelope as set forth in claim 17 which further includes programmable control means for selectively synchronizing and sequencing said sheet feeder with the operation of the extraction of an envelope from said stack of envelopes.

19. Apparatus for extracting an envelope as set forth in claim 18 wherein said control means includes means for selecting one or more sheets with the selection of one or more envelopes.

* * * * *